US009751647B2

(12) United States Patent
Murarotto

(10) Patent No.: US 9,751,647 B2
(45) Date of Patent: Sep. 5, 2017

(54) SYSTEM WITH ROTARY PLATFORM FOR WRAPPING LOADS

(75) Inventor: Emilio Murarotto, Viano (IT)

(73) Assignee: BEMA S.R.L., Viano (Reggio Emilia) (IT)

( * ) Notice: Subject to any disclaimer, the term of this patent is extended or adjusted under 35 U.S.C. 154(b) by 792 days.

(21) Appl. No.: 14/003,995

(22) PCT Filed: Nov. 11, 2011

(86) PCT No.: PCT/IB2011/055053
§ 371 (c)(1),
(2), (4) Date: Sep. 26, 2013

(87) PCT Pub. No.: WO2012/120343
PCT Pub. Date: Sep. 13, 2012

(65) Prior Publication Data

US 2014/0013707 A1 Jan. 16, 2014

(30) Foreign Application Priority Data

Mar. 9, 2011 (IT) ..... VR2011A0049

(51) Int. Cl.
*B65B 11/04* (2006.01)
*B65B 59/04* (2006.01)

(52) U.S. Cl.
CPC ..... *B65B 11/04* (2013.01); *B65B 11/045* (2013.01); *B65B 59/04* (2013.01); *B65B 2210/14* (2013.01)

(58) Field of Classification Search
CPC ..... B65B 11/04; B65B 11/045; B65B 11/585; B65B 59/04; B65B 2210/14
(Continued)

(56) References Cited

U.S. PATENT DOCUMENTS 5,653,087 A * 8/1997 Spada ..... B25J 15/08 242/559.2
2003/0084646 A1* 5/2003 Lancaster, III ..... B65B 11/025 53/399

(Continued)

FOREIGN PATENT DOCUMENTS

EP 1880945 1/2008
WO WO2009130531 10/2009

*Primary Examiner* — Stephen F Gerrity
*Assistant Examiner* — Valentin Neacsu
(74) *Attorney, Agent, or Firm* — Tutunjian & Bitetto, P.C.

(57) ABSTRACT

A system for wrapping loads comprising a rotary platform rotating around a vertical axis, a wrapping head having a reel of film for covering a load, the wrapping head being configured to be selectively associated with a moving machine having a rotatable connection and a plate with removable connections, a support frame configured to support the wrapping head when not associated with the moving machine, the support frame being placed outside of the moving machine and configured on linear rails, the wrapping head including attachments for removable connection to the support frame, the removable connections of the moving machine being configured to support and connect the wrapping head when the wrapping head is associated to the moving machine, the rotatable connection of the moving machine being configured to rotate a plate having the removable connections and to move the wrapping head connected to and supported by the plate toward or away from the support frame so as to facilitate replacement of the wrapping head.

12 Claims, 6 Drawing Sheets

(58) Field of Classification Search
USPC ..... 53/556, 587, 168
See application file for complete search history.

(56) References Cited

U.S. PATENT DOCUMENTS

| | | | | |
|---|---|---|---|---|
| 2008/0229707 | A1* | 9/2008 | Zitella | B65B 11/025 53/64 |
| 2008/0229716 | A1* | 9/2008 | Zitella | B65B 11/025 53/461 |
| 2009/0120307 | A1* | 5/2009 | Koskela | B65B 11/025 100/27 |
| 2009/0313942 | A1* | 12/2009 | Murarotto | B65B 11/025 53/203 |
| 2010/0300049 | A1* | 12/2010 | Schmidt | B65B 11/025 53/461 |
| 2011/0030317 | A1* | 2/2011 | Murarotto | B65B 11/045 53/399 |

* cited by examiner

SYSTEM WITH ROTARY PLATFORM FOR WRAPPING LOADS

TECHNICAL FIELD

The present invention refers to a system for wrapping loads, consisting of one or more products distributed more or less orderly on a pallet for allowing the movement and transportation thereof in a practical and easy manner.

DESCRIPTION OF RELATED ART

Palletized loads are generally covered with a stabilizing casing which immobilizes the load on a pallet and allows the subsequent transportation thereof, without the risk of falling or reversing.

Tightly wrapping the sides of the load, and of the pallet, using a plastic covering film which is unwound from a supply reel is a practice for obtaining said stabilising casing.

The wrapping is generally obtained by using automatic or semi-automatic systems.

A very common wrapping system is that based on a moving machine operating, through a simplified Cartesian coordinate robot, moving the wrapping head mainly in the vertical direction and, simultaneously, winding the covering film on the palletised load rotated on a rotary platform.

Once the covering film has run out, or should the covering film jam, it is required to proceed, after stopping the system, to replace the reel or eliminate the jamming.

These wrapping systems are characterised by a relative construction simplicity, but they reveal the drawback related to the impossibility to operate continuously due to to the long machine stop times required for the replacement of the covering film reel or for the elimination of possible jamming or possible malfunctions related to the reel or film.

SUMMARY OF THE INVENTION

An object of the present invention is to improve the state of the art.

Another object of the present invention is to propose a system for wrapping loads provided with a wrapping head mainly movable in the vertical direction which allows to reduce the system stop times due to the running out or jamming of the covering film.

A further object of the present invention is to propose a system for wrapping loads capable of allowing to change the reel in an automatic and practical manner, reducing the setup and relative system stop times, through a solution that is simple, rational, easy and effective to use as well as relatively inexpensive.

According to an aspect of the present invention a system is provided according to the present principles.

BRIEF DESCRIPTION OF THE DRAWINGS

Further characteristics and advantages of the present invention will be more apparent from the detailed description of a preferred, but not exclusive, embodiment of a system for wrapping loads illustrated by way of non-limiting example with reference to the attached drawings wherein.

DETAILED DESCRIPTION OF PREFERRED EMBODIMENTS

Figure 1:
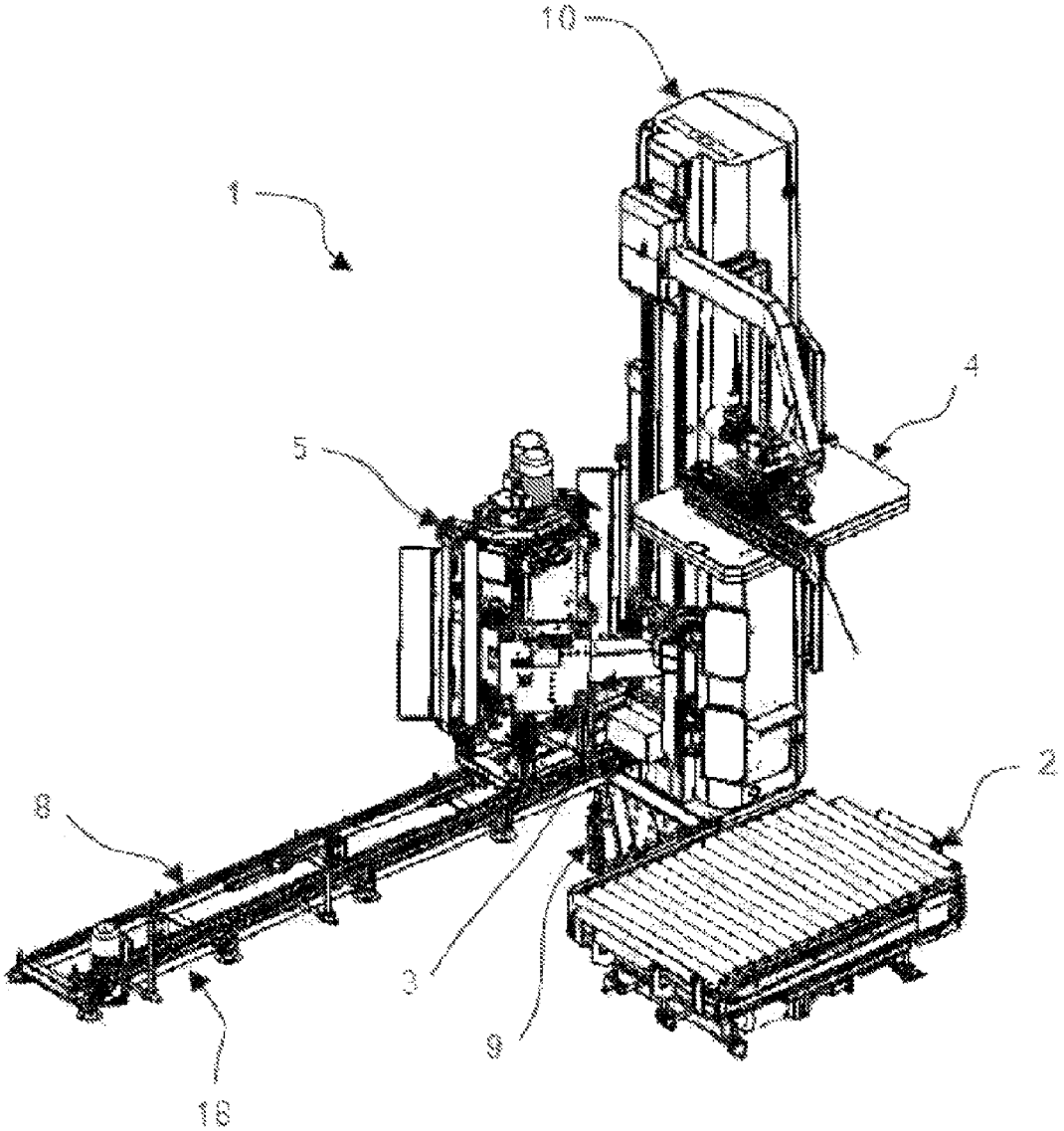
FIG. 1 is an overall perspective view of a system for wrapping loads according to the present invention.
Figure 2:
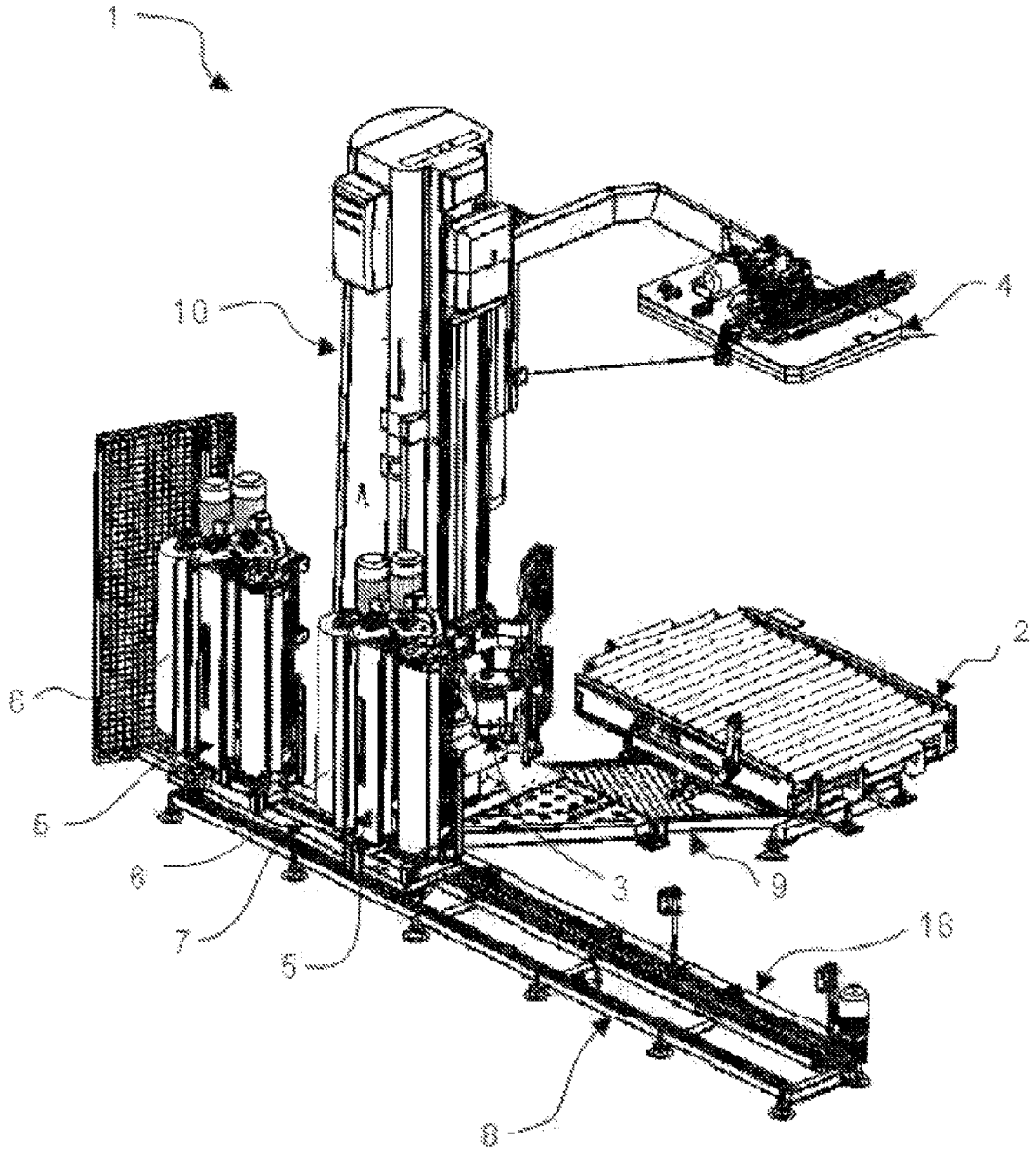
FIG. 2 is an overall perspective view from another angle.

With reference to the attached figures, a system for wrapping loads of the palletised type or the like is indicated schematically with 1.

The system 1 mainly comprises a rotary platform 2 capable of receiving a load, not illustrated in the figures, to be wrapped and capable of rotating it around a vertical rotational axis perpendicular to the ground, a moving machine 3 oriented in a substantially vertical direction relative to the rotary platform 2, a pressing element 4 for retaining the load during the wrapping, a wrapping head 5 provided with a reel 6 of film for covering a load and associated to the moving machine 3, and a support frame. 7 for wrapping heads 5 outside the moving machine 3 and with the possibility of moving with respect thereto.

The moving machine 3 comprises a base 9 for resting on the ground from which a substantially vertical column 10 extends along which a wrapping head 5 is slidably engaged.

The wrapping head 5 comprises a box-shaped body 11 containing means for rotatably actuating the reel 6, means for pre-stretching the covering film and applying it on the load; these means are not described in greater detail given that they are not subject of the present invention.

Figure 3:
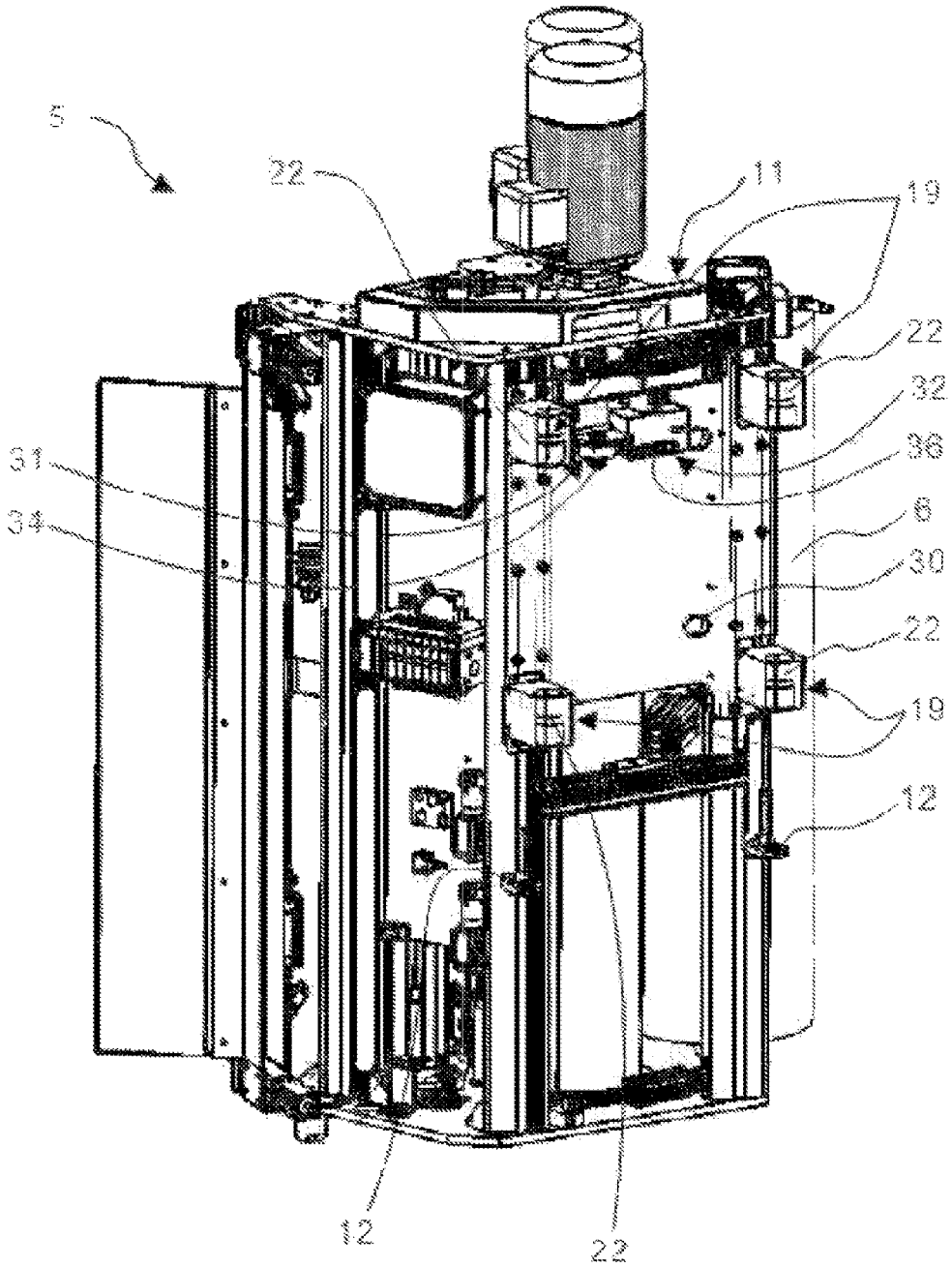
FIG. 3 is a perspective view of the rear portion of the wrapping head.

The box-shaped body 11 has a front portion, which—during use—is faced to the load to be wrapped, and a rear portion provided with first removable attachment elements 12 (FIG. 3) to the support frame 7 for parking the wrapping head 5 when not being used or during replacement.

Figure 4:
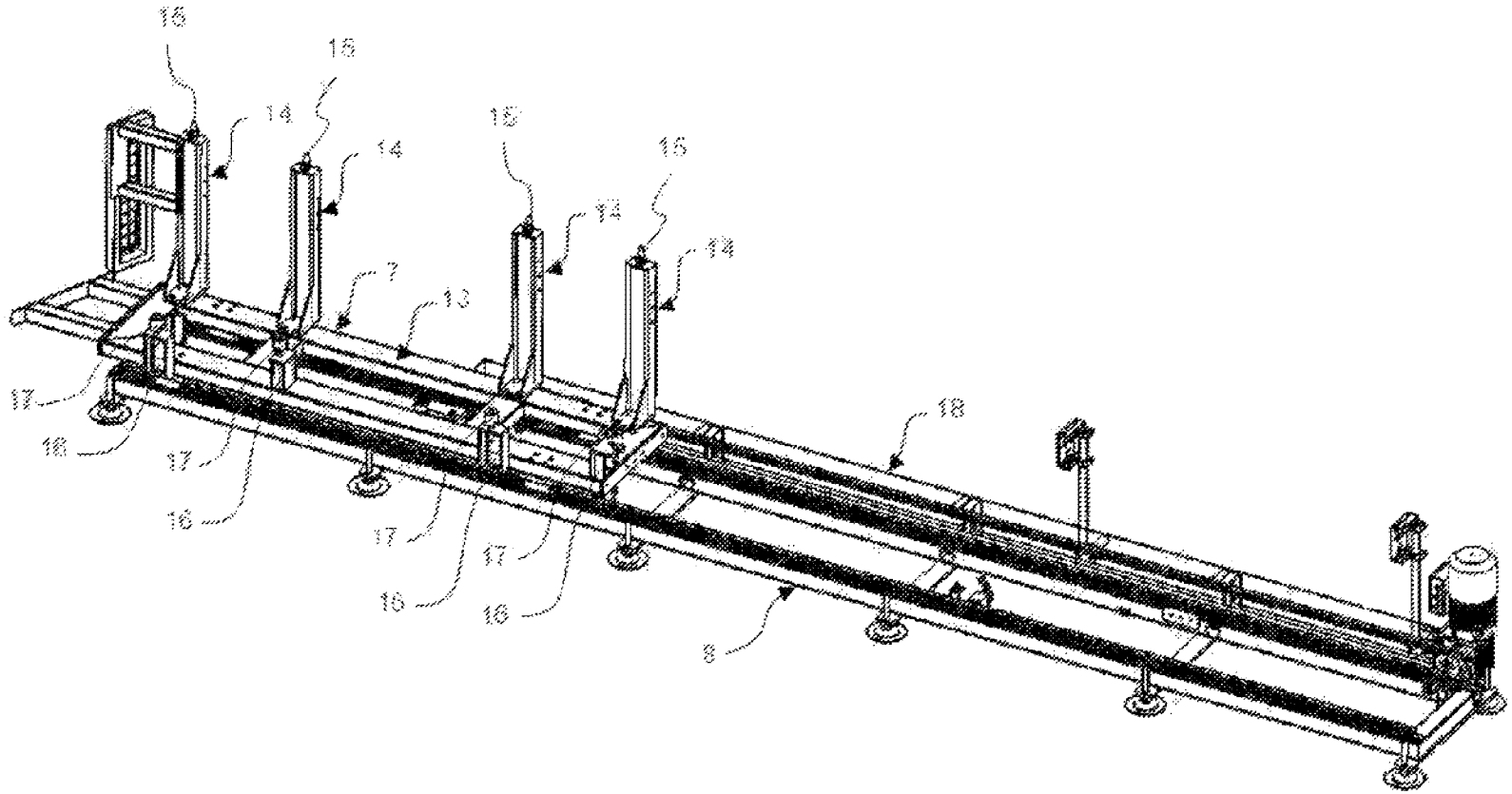
FIG. 4 is a perspective view of the movement rail of the frame for supporting the wrapping heads according to the present invention.
Figure 5:
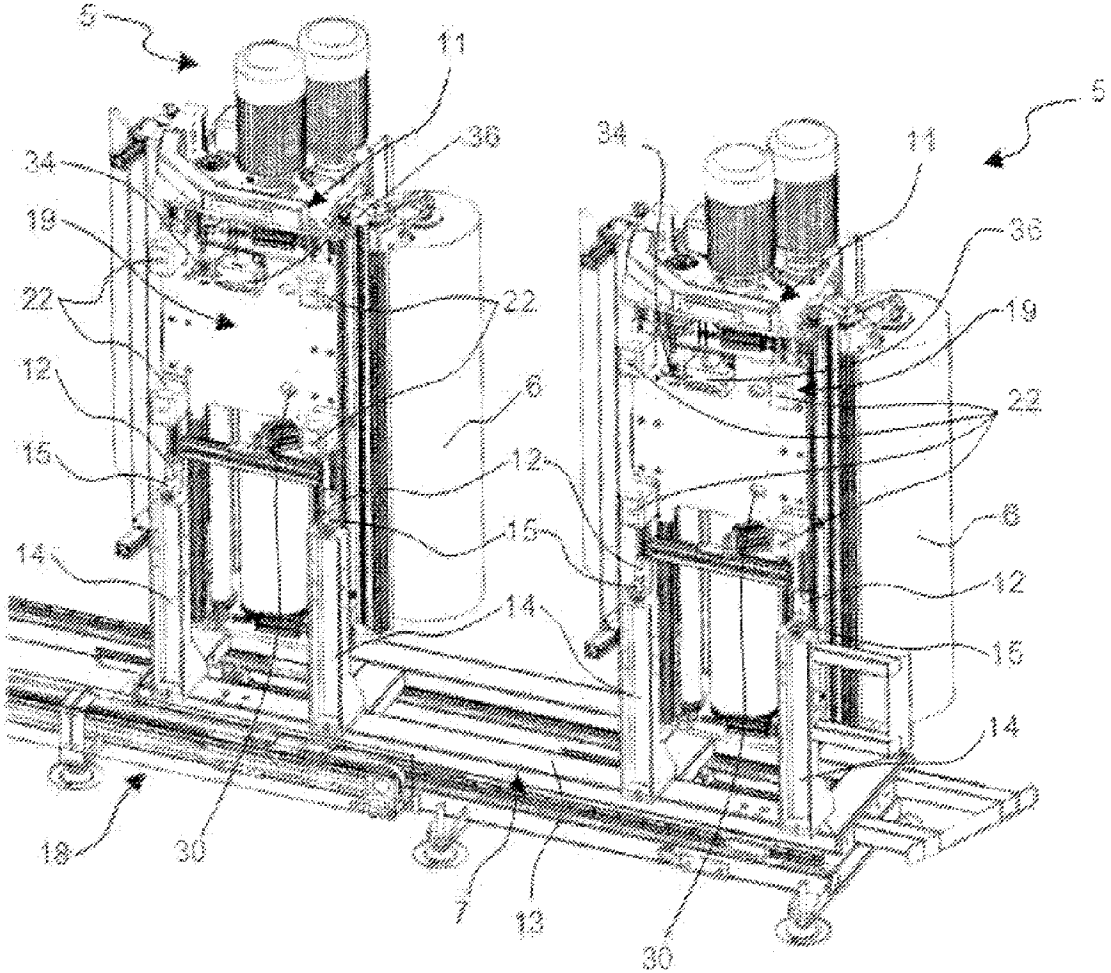
FIG. 5 is an enlarged perspective view of the frame for supporting the wrapping heads with two heads awaiting to be used.
Figure 6:
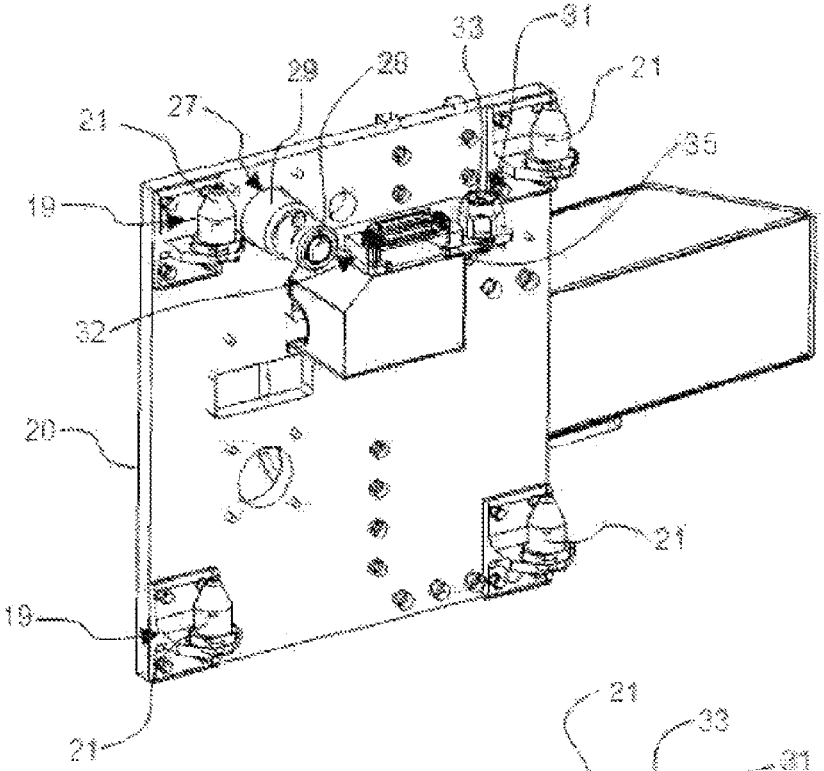
FIG. 6 is an enlarged perspective view of the plate for coupling the wrapping head to the moving machine of the system according to the present invention.

According to what is illustrated in FIGS. 4 and 5, the support frame 7 consists of a beam or box-shaped structure which defines a lower base 13 from which four uprights 14 project upwards each supporting a vertical pin 15 and four uprights 16 each of which support a support element 17.

The support, frame 7 is arranged on displacement means 8, 18, so as to be able to move with respect to the moving machine 3.

The movement of the frame 7 occurs between two main positions: a position in proximity of the moving machine 3 to allow the replacement of the wrapping head 5, and a position moving away from the moving machine 3 to allow to load a new film reel 6.

The support frame 7 has at least two seats for two respective wrapping heads 5, so as to have at least one seat available for the deposit of a previously used wrapping head and a seat in which a wrapping head ready for use is arranged.

For example, according to what is illustrated in FIG. 4, the displacement means comprise a linear rail 8 on which the support frame 7 is slidably engaged.

Obviously, other different methods for moving the frame 7 are possible: for example the frame 7 may travel a circle arc through a rotary arm or circular guiding means or otherwise shaped means or other equivalent means.

The movement of the support frame 7 along the rail 8 is controlled through a linear movement system 18. The wrapping head 5 is provided with second removable attachment means 19 to a plate 20 associated with the moving machine 3.

The second removable attachment means 19 comprise at least four hooking elements 21 which extend vertically from the plate 20, and an equivalent number of abutment elements 22 associated to the wrapping head 5 and able to be coupled with the hooking elements 21 along a direction of substantially vertical mutual engagement and disengagement.

Figure 7:
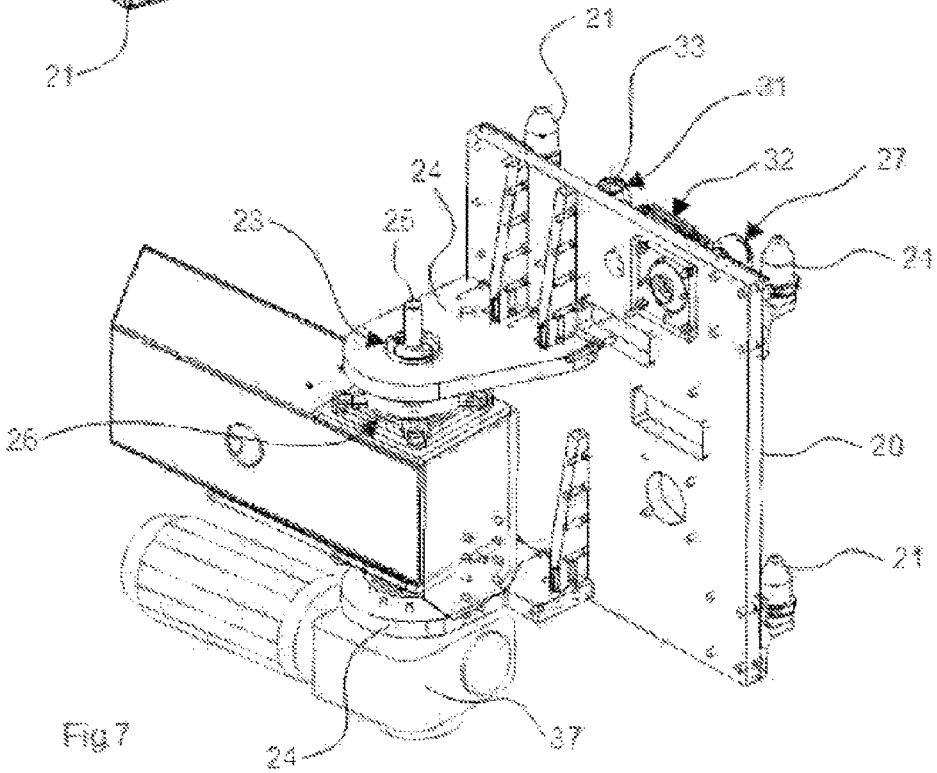
FIG. 7 is an enlarged perspective view of the plate from another angle.

According to what, is illustrated in FIG. 7, the plate 20 is associated with the moving machine 3 through a special rotatable connection 23 between a pair of brackets 24 and the moving machine 3.

The rotatable connection 23 is obtained through a pin 25 and a rotary member 26. The rotatable connection 23 can allow a rotation of the plate 20 by at least 180° around the vertical axis of the pin 25, so as to facilitate an easy replacement of the wrapping head 5. The rotatable connection 23 is controlled through actuation means 37 illustrated in FIG. 7: for example, a gearmotor or a pneumatic or electrical actuator which allows for performing a rotation of the rotatable connection 23 by at least 180°.

In the particular embodiment of the invention illustrated in the figures, the hooking elements 21 are represented projecting upwards so as to be able to be introduced from downwards into the abutment elements 22 and to support the weight of the wrapping head 5 during use.

The second removable attachment means 19 comprise retention means 27 adapted to prevent the relative sliding between the hooking elements 21 and the abutment elements 22 once coupled to each other.

Such retention means 27 consist of a bar 28 housed within a tubular section 29 projecting orthogonally to the plate 20. The bar 28 can protrude from the tubular section 29 to be inserted into an abutment opening 30 obtained on the rear portion of the box-shaped body 11.

Pneumatic connection means 31 and electronic connection means 32 are also provided able to be interposed between the moving machine 3 and the wrapping head 5 adapted to supply with compressed air, electrical energy and electronic signals the means housed within the box-shaped body 11 for the operation of the wrapping head 5.

The pneumatic connection means 31 comprise a first joint 33 associated to and projecting from the plate 20 facing upwards and a second joint 34 associated to the box-shaped body 11 and facing downwards.

The aforementioned electronic connection means 32 consist of a first electronic port 35 associated in a projecting manner to the plate 20 and facing upwards and a second electronic connection port 36 associated in a projecting manner to the box-shaped body 11 of the wrapping head 5 and facing downwards. The electronic connection means 35 and 36 can have a predefined longitudinal and transverse clearance to facilitate the coupling and decoupling of the connection during the replacement of the wrapping head 5.

The pneumatic connection and the electronic connection are established and integral with each other when the wrapping head 5 is mounted on the moving machine 3.

The present invention operates as follows.

Once the film reel 6 has run out or in case of, jamming, the wrapping head 5 is replaced automatically, requiring a limited machine stop, through the following steps.

The support frame 7 for the wrapping heads 5 is moved along the rail 8 through the movement system 18 until it comes in proximity of the moving machine 3 in a predefined position to replace the wrapping head 5.

The wrapping head 5 installed on the moving machine 3 is approached to the support frame 7 by rotating the rotatable connection 23 positioning the first removable attachment elements 12 of the box-shaped body 11 aligned at the pins 15 mounted on the uprights 14 of the support frame 7; it should be observed that the support frame 7 and in particular the uprights 14 are obtained so as not to interfere with the rotational movement of the rotatable connection 23.

In order to allow the detachment of the wrapping head 5 from the moving machine 3, the retention means 27 are released by returning the bar 28 within the tubular section 29, allowing the relative sliding between the hooking elements 21 and the abutment elements 22.

The moving machine 3 is lowered by placing—in mutual contact—the first attachment means 12 with the pins 15 and the box-shaped body 11 with the support elements 17, by disconnecting the wrapping head 5 from the moving machine 3.

Furthermore, in this stage the pneumatic and electronic connections between the moving machine 3 and the wrapping head 5 are released by decoupling the pneumatic connection means 31 and electronic connection means 32.

The plate 20 is moved away from the support frame 7 by rotating the rotatable connection 23.

The wrapping head 5 ready for use, and positioned awaiting on the support frame 7, is approached to the plate 20 of the moving machine 3 by sliding the support frame 7 along the movement rail 8.

The plate 20 is approached to the support frame 7 by rotating the rotatable connection 23 up to positioning the hooking elements 21 of the plate 20 at the abutment means 22. The plate 20 is raised through the moving machine 3, thus allowing the insertion of the hooking elements 21 of the plate 20 in the second removable attachment means 19 integral with the wrapping head 5.

In order to avoid the inadvertent detachment of the wrapping head 5 from the moving machine 3 and thus lock, the wrapping head 5 with the moving machine 3 retention means 27 are actuated through the protrusion of the bar 28 from the tubular section 29 and the subsequent insertion of the bar 28 in the abutment opening 30 on the rear portion of the box-shaped body 11.

Furthermore, when raising the plate 20 the pneumatic and electronic connection between the moving machine 3 and the wrapping head 5 respectively occurs through the pneumatic connection means 31 and electronic connection means 32.

The described apparatus attains the objects proposed in a solution having small and optimized overall dimensions. The presence of the movement rail 8, or an. equivalent means, downstream of the wrapping system 1 engages, in a limited way, a partly non-usable area in that it is intended to move the wrapped load thus allowing to maintain the area upstream of the system free.

The invention thus conceived can be subjected to numerous modifications and variants all falling within the scope of inventive concept.

Furthermore, all details can be replaced by other technically equivalent elements. In practice, the materials used, as well as the shapes and the contingent dimensions, may vary depending on the requirements without departing from the scope of protection of the following claims.

The invention claimed is:

1. A system for wrapping loads comprising:

a rotary platform capable of rotating around a vertical axis;

a moving machine oriented in a vertical direction relative to the rotary platform;

a wrapping head provided with at least one reel of film for covering a load, the wrapping head being configured to be selectively associated with said moving machine;

a support frame configured to support said wrapping head when not associated with said moving machine, said support frame being placed outside of the moving machine and arranged on displacement means;

wherein said wrapping head comprises first removable attachment elements configured to removably connect said wrapping head to said support frame when the wrapping head is not associated to the moving machine, wherein the moving machine comprises a rotatable connection and a plate having second removable attachment means configured to removably connect to and support said wrapping head when the wrapping head is associated to the moving machine, wherein the rotatable connection of the moving machine is configured to rotate the plate and move the wrapping head connected to and supported by the plate toward or away from the support frame so as to facilitate replacement of said wrapping head.

2. The system according to claim 1, wherein said displacement means comprises a rail and a movement system for said support frame.

3. The system according to claim 1, wherein said support frame comprises connection means for connecting to said wrapping head.

4. The system according to claim 3, wherein said connection means comprise vertical pins.

5. The system according to claim 4, wherein said vertical pins tightly fit into the first removable attachment elements.

6. The system according to claim 1, wherein said first removable attachment elements are fixed to said wrapping head.

7. The system according to claim 1, wherein said rotatable connection comprises a pin and a rotary member.

8. The system according to claim 7, wherein said rotatable connection determines a relative rotation between said wrapping head and said moving machine.

9. The system according to claim 8, wherein said rotation has an amplitude of at least 180°.

10. The system according to claim 8, wherein said rotation is carried out through actuation means.

11. The system according to claim 1, wherein said displacement means move the support frame between a position close to the moving machine to allow the replacement of the wrapping head, and a position away from the moving machine to allow a new reel of film to be loaded.

12. The system according to claim 1, wherein said displacement means comprise a linear rail on which the support frame is slidably engaged and a linear movement system.

* * * * *